US010793301B2

(12) United States Patent
Kawano

(10) Patent No.: US 10,793,301 B2
(45) Date of Patent: Oct. 6, 2020

(54) FILM TRANSPORT APPARATUS, FILM TRANSPORT METHOD, AND FILM ATTACHMENT APPARATUS

(71) Applicant: TOYOTA JIDOSHA KABUSHIKI KAISHA, Toyota-shi (JP)

(72) Inventor: Takayuki Kawano, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/269,382

(22) Filed: Feb. 6, 2019

(65) Prior Publication Data

US 2019/0270529 A1 Sep. 5, 2019

(30) Foreign Application Priority Data

Mar. 2, 2018 (JP) ..... 2018-037745

(51) Int. Cl.
*B65H 16/00* (2006.01)
*B65B 7/16* (2006.01)
(Continued)

(52) U.S. Cl.
CPC ..... *B65B 7/162* (2013.01); *B65H 16/005* (2013.01); *B65H 16/021* (2013.01); *B65H 35/006* (2013.01); *B65H 35/0086* (2013.01); *B65H 35/06* (2013.01); *B65H 2301/121* (2013.01); *B65H 2301/4128* (2013.01); *B65H 2301/4471* (2013.01); *B65H 2301/51532* (2013.01); *B65H 2405/52* (2013.01); *B65H 2801/81* (2013.01)

(58) Field of Classification Search
CPC .. B65H 16/005; B65H 16/021; B65H 35/006; B65H 35/0086; B65H 35/06; B65H 2301/121; B65H 2301/2128; B65H 2301/4471; B65H 2301/51532; B65H 2405/52; B65H 2801/81; B65H 20/16; B65H 75/28
USPC ..... 83/411.1, 206, 650; 225/34, 38; 242/579, 580
See application file for complete search history.

(56) References Cited

U.S. PATENT DOCUMENTS 4,583,348 A * 4/1986 Treiber ..... B65B 11/54 53/389.3
4,825,622 A * 5/1989 Nigg ..... B65B 41/16 53/203

FOREIGN PATENT DOCUMENTS

CA 2362397 A1 * 7/2001 ..... B65B 41/12
JP 08-208066 8/1996
JP 2005-272125 10/2005

* cited by examiner

*Primary Examiner* — Andrea L Wellington
*Assistant Examiner* — Liang Dong
(74) *Attorney, Agent, or Firm* — Oblon, McClelland, Maier & Neustadt, L.L.P.

(57) ABSTRACT

Provided is a film attachment apparatus and a film transport method by which it is easy to switch a film each time, and a film attachment apparatus including the film transport apparatus. The film transport apparatus includes: a film holding unit configured to hold a long-length film; and a film cutting unit configured to cut out the film, in which the film holding unit holds the plurality of films, and the film transport apparatus further includes: a temporary holding unit configured to include a plurality of temporary holding mechanisms that temporally hold the films between the film holding unit and the film cutting unit; and a first transport arm configured to select and pull out one film from the plurality of films which are held in the temporary holding unit.

5 Claims, 9 Drawing Sheets

(51) Int. Cl.

| | |
|---|---|
| ***B65H 16/02*** | (2006.01) |
| ***B65H 35/00*** | (2006.01) |
| ***B65H 35/06*** | (2006.01) |

FILM TRANSPORT APPARATUS, FILM TRANSPORT METHOD, AND FILM ATTACHMENT APPARATUS

CROSS REFERENCE TO RELATED APPLICATIONS

This application is based upon and claims the benefit of priority from Japanese patent application No. 2018-37745, filed on Mar. 2, 2018, the disclosure of which is incorporated herein in its entirety by reference.

BACKGROUND

The present disclosure relates to a film transport apparatus, a film transport method, and a film attachment apparatus.

Coating is well known as a method for adding a color to a workpiece which is a part of a vehicle or the like. A method for adding a color to a workpiece by attaching a color film or the like has been studied instead of coating, which requires a large energy consumption. With the addition of a color by attaching the film, the amounts of energy consumption and carbon dioxide emissions can be reduced compared with when coating is performed. As a method for handling a roll film or the like, for example, the following Japanese Unexamined Patent Application Publication No. H8-208066 and Japanese Unexamined Patent Application Publication No. 2005-272125 have been disclosed.

Japanese Unexamined Patent Application Publication No. H8-208066 discloses a technique in which electricity is removed from a sheet object at a specific position in a method for manufacturing a label for cutting a sheet object on the side where a transporting roll is discharged while transporting the sheet object by using a transporting roll.

Japanese Unexamined Patent Application Publication No. 2005-272125 discloses a method for replacing a film supply roll in which a plurality of roll films supported by a shaft are provided to determine whether a switching process has normally performed based on means for detecting a rotation of the shaft in a method for replacing a film supply roll in which a roll which is a source of a film supply is switched.

SUMMARY

A film for adding a color is generally supplied as a film roll and the replacement of the film roll has been difficult under present circumstances. Therefore, workpieces having the same color have been produced by lots in units of film rolls. It may be possible to provide a plurality of lines for each color. However, providing the plurality of lines has been difficult since it is necessary to increase a size of a facility in the case of large parts used for automobiles or the like. Further, it does not improve productivity. Under such a circumstance, an apparatus capable of switching films having different colors every time to add different colors to a plurality of workpieces by using one line is demanded.

The present disclosure has been made in view of the above-described circumstances and provides a film transport apparatus and a film transport method by which it is easy to switch a film every time, and a film attachment apparatus including the film transport apparatus.

A first exemplary aspect is a film transport apparatus including: a film holding unit configured to hold a long-length film; and a film cutting unit configured to cut out the film, in which the film holding unit holds a plurality of the films, and the film transport apparatus further includes: a temporary holding unit configured to include a plurality of temporary holding mechanisms that temporally hold the films between the film holding unit and the film cutting unit; and a first transport arm configured to select and pull out one film from the plurality of films which are held in the temporary holding unit.

In the above first exemplary aspect of the film transport apparatus, the temporary holding mechanism includes a contact part in which it applies a frictional force on both sides of the film.

In the first exemplary aspect of the above film transport apparatus, the plurality of temporary holding mechanisms are provided so that a relative distance between each of them can be changed respectively, and before the first transport arm pulls out one selected film, the relative distance between the temporary holding mechanism that holds the selected film and another temporary holding mechanism is increased.

In the first exemplary aspect of the above film transport apparatus, a relative distance of a temporary holding mechanism is maintained until a next film is selected, and the relative distance is maintained in the case where the next film is the same as that previously selected.

In the first exemplary aspect of the above film transport apparatus, the film transport apparatus includes a second transport arm closer to a side where a film is pulled out than the film cutting unit, and after the first transport arm has pulled out the film, the second transport arm grasps the pulled film before the film cutting unit cuts out the pulled film.

Another exemplary aspect is a film attachment apparatus including: the film transport apparatus of the embodiment; and a film attachment unit that is provided closer to a side where a film is pulled out than the film cutting unit is, in which the film attachment unit includes a container body capable of accommodating a workpiece and a lid body that seals the container body, the first transport arm is provided so as to be able to pass between the container body and the lid body, and the first arm transport arm that grasps the film passes between the container body which has accommodated the workpiece and the lid to place the film on the workpiece.

Another exemplary aspect is a film transport method for selecting and pulling out one film from a plurality of films, including: preparing a plurality of long-length films; pulling out one end of each one of the plurality of films and arranging the one ends in parallel; making the first transport arm grasp one selected film; moving the first transport arm to pull out the selected film to a predetermined position; and cutting the film at the predetermined position to be a sheet film.

According to the present disclosure, it is possible to provide a film transport apparatus and a film transport method by which it is easy to switch a film every time, and a film attachment apparatus including the film transport apparatus.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

A film transport apparatus, a film attachment apparatus, and a film transport method according to embodiments are described hereinafter. Note that for clarifying the explanation, the following descriptions and the drawings are omitted and simplified as appropriate. The same symbols are assigned to the same components throughout the drawings and duplicated explanations are omitted as required.

Figure 1:
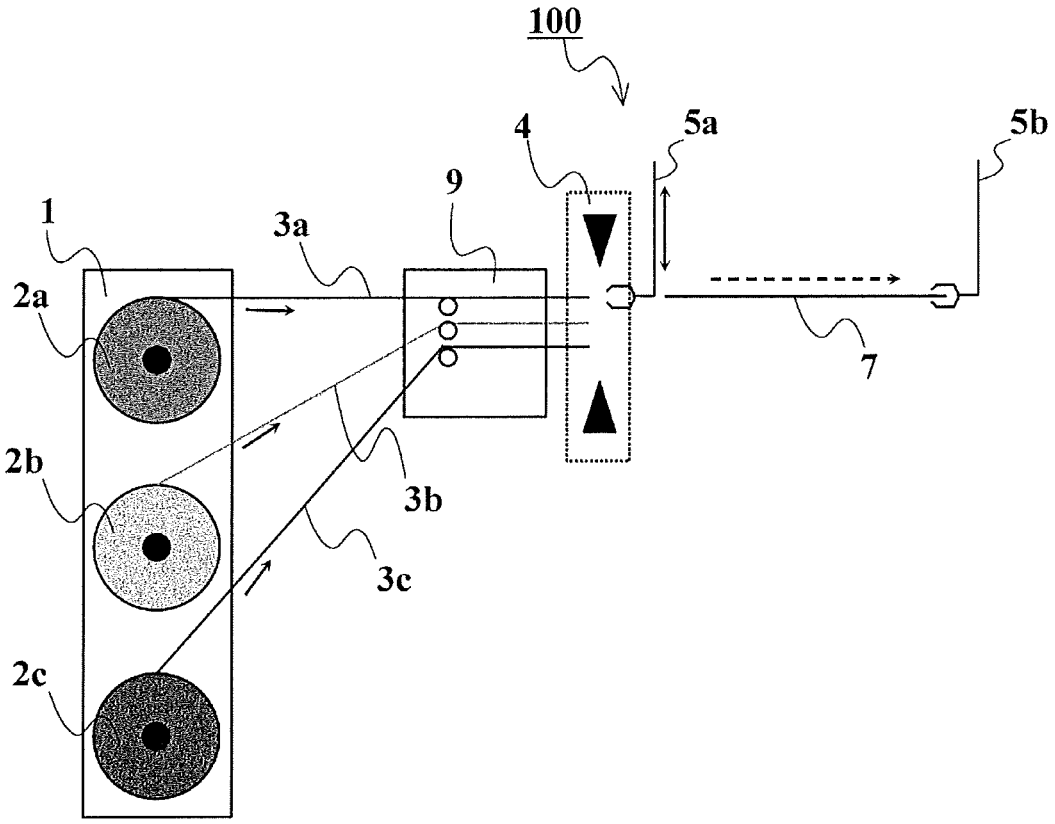
FIG. 1 is a schematic view showing an example of a film transport apparatus according to an embodiment.

First, a configuration of a film transport apparatus according to this embodiment will be described with reference to FIG. 1. FIG. 1 is a schematic view showing an example of the film transport apparatus according to this embodiment. A film transport apparatus 100 in the example shown in FIG. 1 includes: a film holding unit 1 configured to hold a long-length film; and a film cutting unit 4 configured to cut out the film, in which the film holding unit 1 holds the plurality of long-length films such as film rolls (2*a*, 2*b* and 2*c*), and the film transport apparatus further includes: a temporary holding unit 9 configured to include a plurality of temporary holding mechanisms that temporally hold the films (3*a*, 3*b*, and 3*c*) between the film holding unit 1 and the film cutting unit 4; and a first transport arm 5*a* configured to select and pull out one film among the plurality of films which are held in the temporary holding unit 9. Note that the first transport arm 5*a* and a first transport arm 5*b* shown in FIG. 1 are the same transport arm and respectively shows a state before a film is transported and a state after the film was transported. Further, a film 7 shown in FIG. 1 is a film which was cut out from the film 3*a* and was transported.

In the example of FIG. 1, the films (3*a*, 3*b*, and 3*c*) are pulled out from the film rolls (2*a*, 2*b*, and 2*c*), which are held in the film holding unit 1 in advance, to predetermined positions in the temporary holding unit 9 to be loaded. The ends of the pulled films are arranged, for example, in parallel with a vertical direction of the film transport apparatus 100 as shown in FIG. 1. A method for loading is not particularly limited and the loading may be performed automatically or manually. The first arm 5*a* moves in a vertical direction of FIG. 1 while holding an end of a selected arbitrary film to transport a film (for example, the film 3*a*) by pulling out the same to a predetermined position. The film transported to the predetermined position is cut by the film cutting unit 4 to be a sheet film 7 transported to the predetermined position.

With the film transport apparatus according to this embodiment, different films can be used by replacing them every time by using one line without replacing film rolls. For example, films having different colors are prepared in the film holding unit so that products having different colors in units of one piece can be manufactured. Therefore, in particular, the film transport apparatus according to this embodiment can be suitably used as a film transport apparatus for one-piece flow production. Details of each configuration of the film transport apparatus will be described hereinafter with reference to the drawings.

Figure 2:
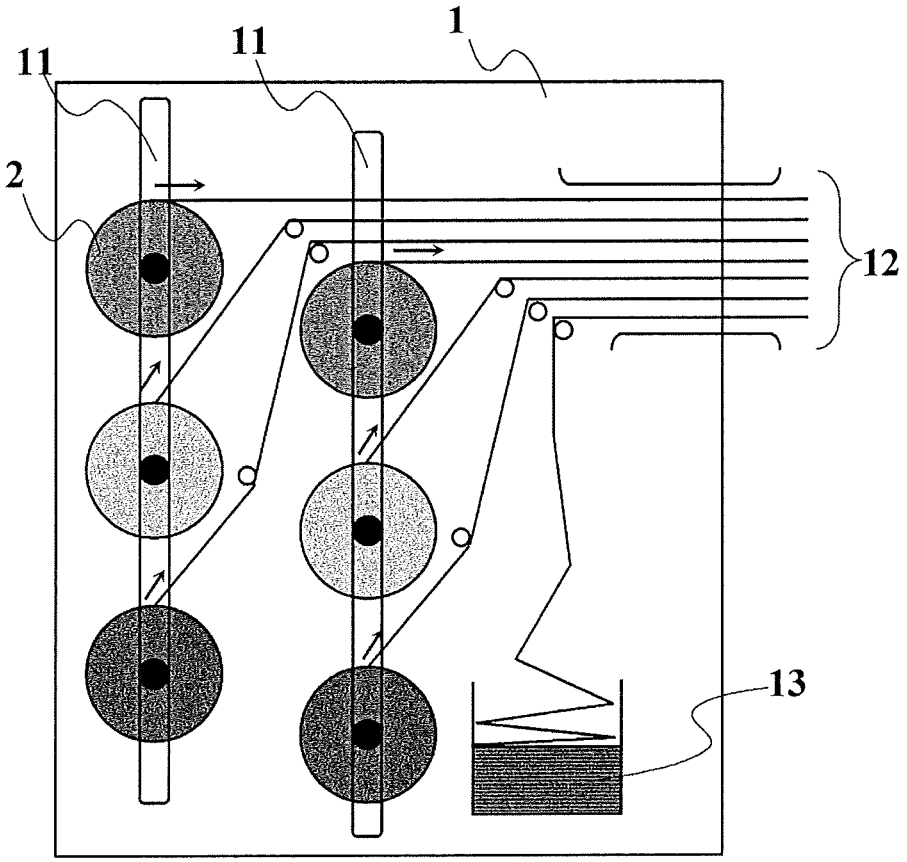
FIG. 2 is a schematic view showing an example of a film holding unit.

FIG. 2 is a schematic view showing an example of the film holding unit 1. In the example of FIG. 2, a plurality of film rolls 2 and a zigzag-folded film 13 are used as long-length films. The film rolls are held in a film roll holder 11 capable of holding a plurality of film rolls. Each of the long-length films is pulled out from a film exit 12 to the film transport unit, which is described later. As shown in the example of FIG. 2, the long-length films may have arbitrary shapes, such as a roll shape or a zigzag-folded shape. At least two long-length films are needed and the number of the long-length films can be set arbitrarily according to uses, etc. The kinds of films are arbitrary and the films may be, in addition to a single colored film, a decorative film having a pattern or the like, a protective film that protects a workpiece, and a film layered by these films. Further, positions of the film roll holder 11 and a guide roll can be set arbitrarily within a range where the films do not come into contact with each other.

Figure 3:
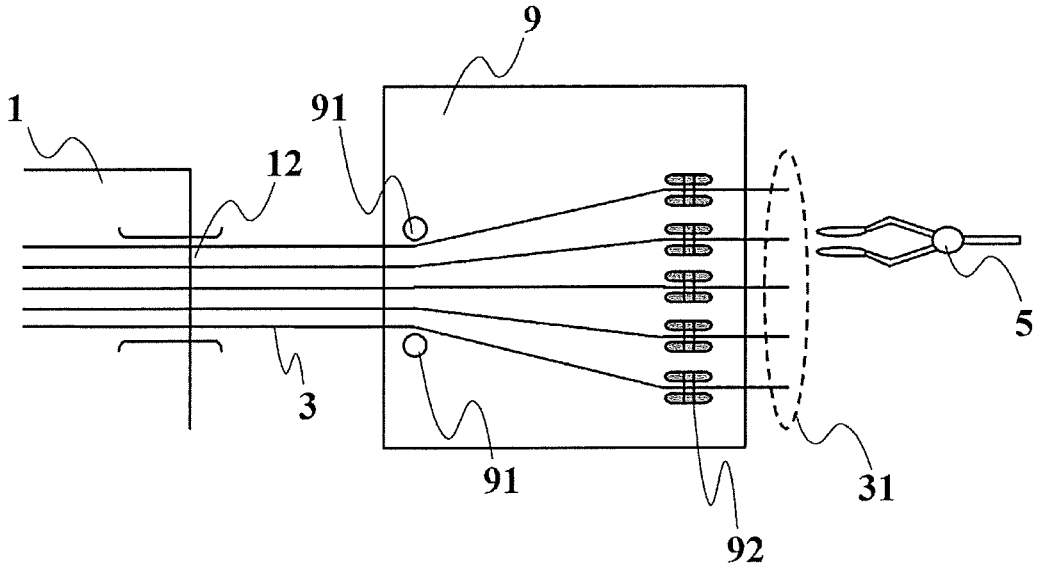
FIG. 3 is a schematic view showing an example of a film temporary holding unit.

FIG. 3 is a schematic view showing an example of a film temporary holding unit 9. The film temporary holding unit 9 temporarily holds a plurality of films 3 pulled out from the film exit 12 of the film holding unit 1 and makes the first transport arm 5 grasp an end 31 of the selected film to pass the end 31. Guides 91 provided on the entrance side of the films and temporary holding mechanisms 92 which temporarily hold the films are included in the example of the film temporary holding unit 9 shown in FIG. 3. The number of the temporary holding mechanisms 92 provided is at least the same as that of the long-length films, and the temporary holding mechanisms 92 are installed at predetermined positions and arranged so that the first transport arm 5 can grasp the end 31 of the film. The temporary holding mechanisms may be fixed so that there are predetermined intervals between them. Further, they may be movable ones as shown in FIG. 4.

Figure 4:
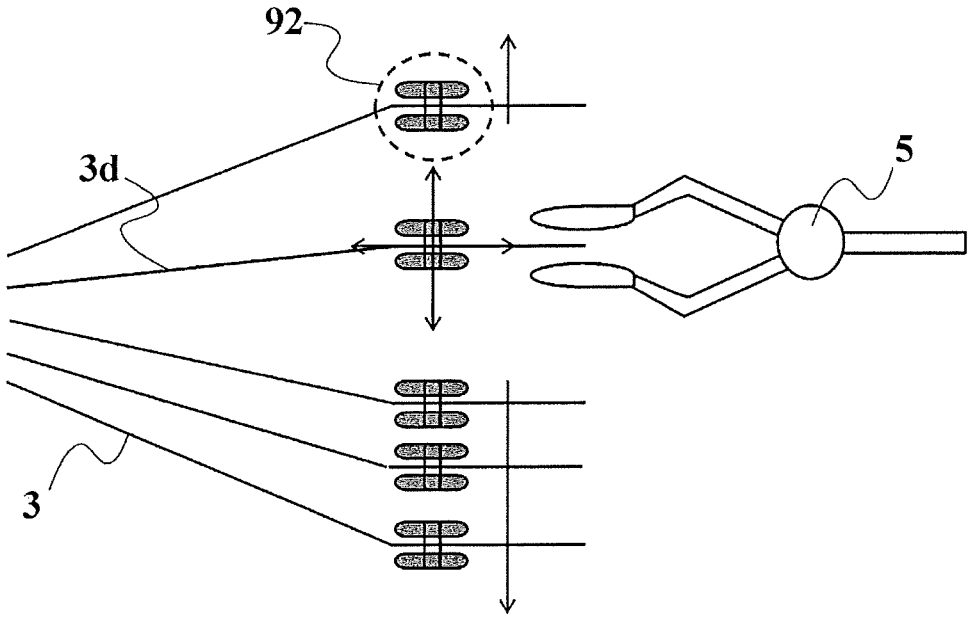
FIG. 4 is a schematic view for explaining a movement of a temporary holding mechanism of the film temporary holding unit.

FIG. 4 is a schematic view for explaining a movement of the temporary holding mechanism of the film temporary holding unit. FIG. 4 is a diagram showing a configuration in which the films 3, the temporary holding mechanisms 92, and the first transport arm 5 are extracted from the example of FIG. 3. When the temporary holding mechanisms 92 are movable, the plurality of temporary holding mechanisms 92 can move to change a relative distance between each of them. For example, when the first transport arm 5 pulls out the selected film 3*d* to grasp it, the temporary holding mechanism 92 holding the selected film 3*d* and other temporary holding mechanisms are vertically moved to make a relative distance therebetween larger so that the first transport arm 5 can easily pull out the selected film 3*d*. Further, a relative distance of the temporary holding mechanism from the other temporary holding mechanisms is maintained until the next film is selected, and that relative distance may be maintained when the next film is the same as that previously selected. In this manner, production efficiency in the case of successively using the same film can be improved.

Figure 5A:
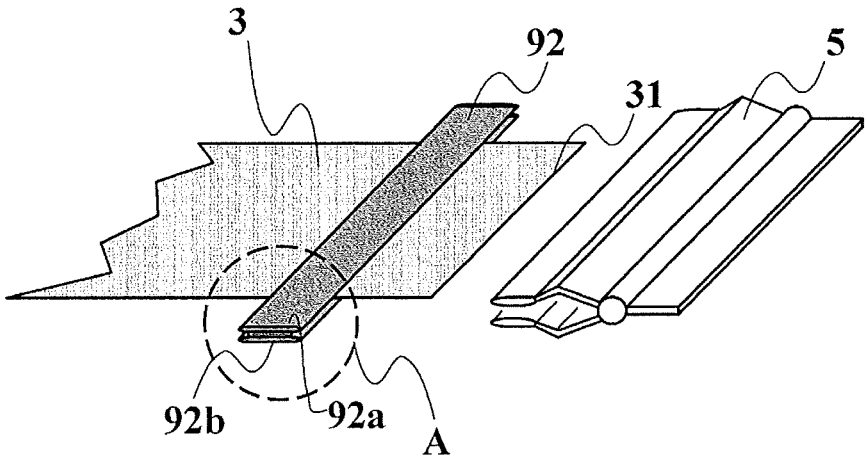
FIG. 5A is a perspective view for explaining the temporary holding mechanism.
Figure 5B:
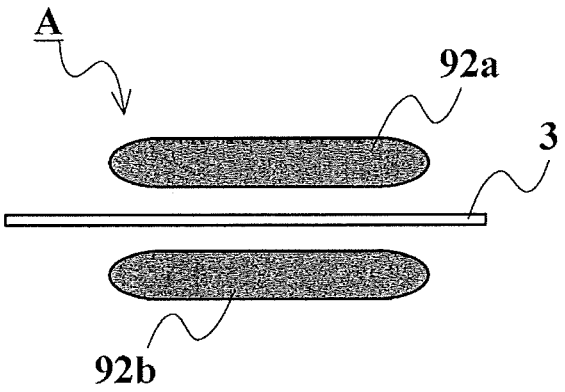
FIG. 5B is a side view for explaining the temporary holding mechanism.

Next, details of the temporary holding unit 92 are described with reference to FIG. 5. FIG. 5A is a perspective view for explaining the temporary holding mechanism. Further, FIG. 5B is an enlarged side view of a part A in the perspective view (FIG. 5A). The temporary holding mechanism 92 shown in the example of FIG. 5 includes a lower part 92*b* that holds the film 3 from below and an upper part 92*a* that holds the film 3 from above, and the upper and lower parts 92*a* and 92*b* function as an integral whole. The temporary holding mechanism 92 has a function of preventing contact between a plurality of films and grasping a film until the first transport arm pulls out the film in a state where the first transport arm 5 can grasp the end 31. The upper and lower parts 92*a* and 92*b* of the temporary holding mechanism 92 come into contact with each other through the film 3 so as to hold and grasp the film 3. Shapes of the upper and lower parts 92*a* and 92*b* of the temporary holding mechanism 92 may be arbitrary shapes providing the above function, and may be a flat-plate shape as shown in FIG. 5, a cylindrical shape, or the like. The temporary holding unit 92, in order to prevent a return of the film in a direction of the film temporary holding unit 92, preferably includes a contact part in which the upper and the lower parts 92*a* and 92*b* apply a frictional force on the film.

Figure 6:
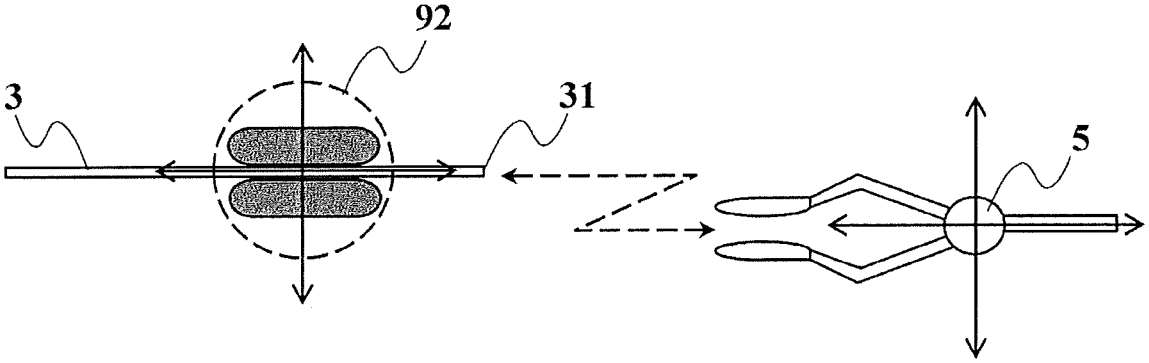
FIG. 6 is a schematic view for explaining a method in which a first transport arm grasps a film.

FIG. 6 is a schematic view for explaining a method in which the first transport arm 5 grasps the film 3. As shown in the example of FIG. 6, the first transport arm 5 vertically moves to adjust the height of the film, and can reliably grasp an end of the film by finely adjusting it in a direction in which the film flows and the vertical direction according to the state of the film, or the like. When the temporary holding mechanism 92 is movable, the temporary holding mechanism 92 may be moved in the direction in which the film flows and the vertical direction to be adjusted finely. For example, by making the first transport arm 5 include a camera or a sensor, accuracy can be further improved. A method for grasping a film by the first transport arm 5 may be a method in which a film is adhered to the first transport arm 5 by air, and a method in which a film is bonded to the first transport arm 5 by using a tackiness agent or the like, in addition to a method in which a film is held and grasped.

Figure 7:
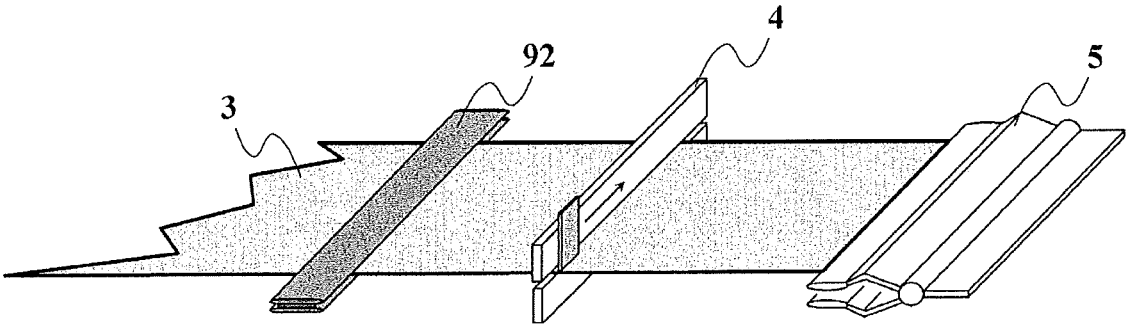
FIG. 7 is a schematic view showing an example of a film cutting unit.
Figure 8:
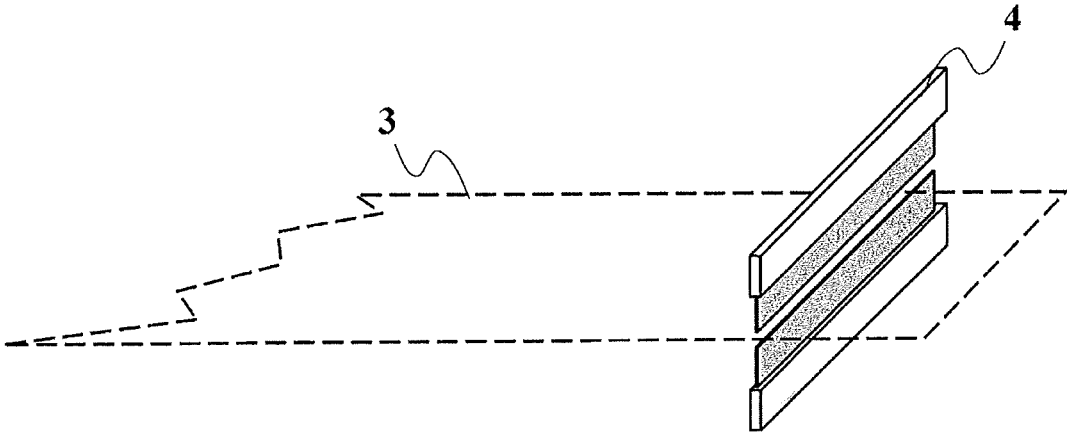
FIG. 8 is a schematic view showing another example of the film cutting unit.

FIGS. 7 and 8 are schematic views, respectively, showing an example of the film cutting unit. The film cutting unit 4 has a function of cutting the film 3 pulled out by the first transport arm 5 at a predetermined position. The film cutting unit 4 shown in the example of FIG. 7 cuts a film by moving a head provided with cutting means such as a blade, a laser or the like toward a width direction of the film. Further, the film cutting unit 4 shown in the example of FIG. 8 cut a film all at once by using cutting means such as a blade provided over a width direction of the film. In this embodiment, both of the above techniques can be used suitably. Cutting means for a film are appropriately selected according to film characteristics and examples of the cutting means include a method for cutting a film using a blade, a laser, heat, or the like.

Figure 9A:
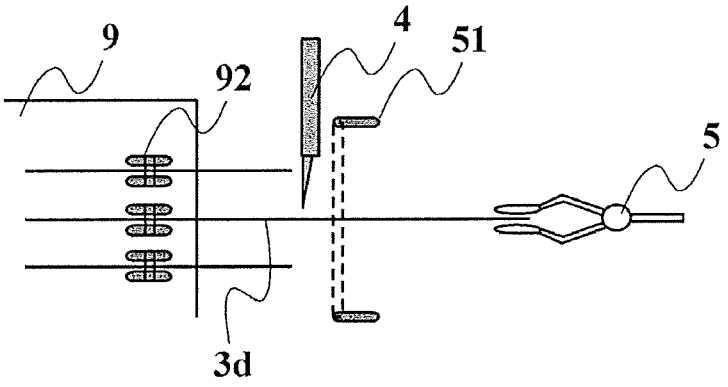
FIG. 9A is a schematic view showing an example of an initial state of the film transport apparatus including a second transport arm.
Figure 9B:
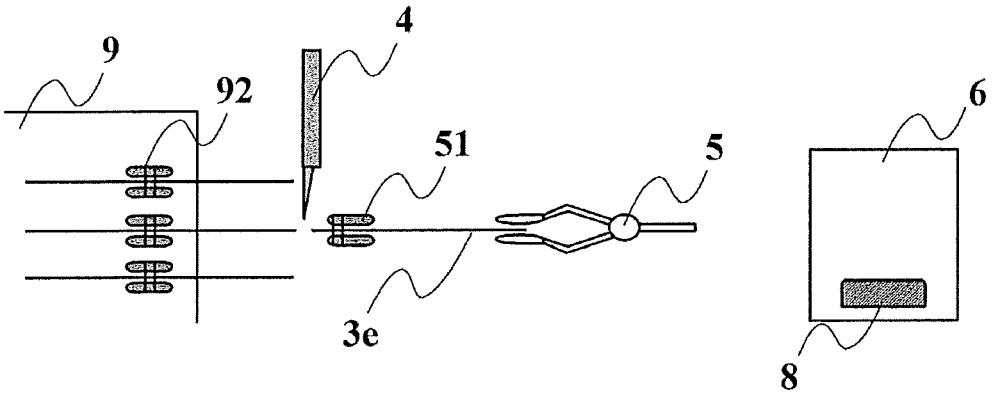
FIG. 9B is a schematic view showing an example of a state in which a transport arm is grasping a film.
Figure 9C:
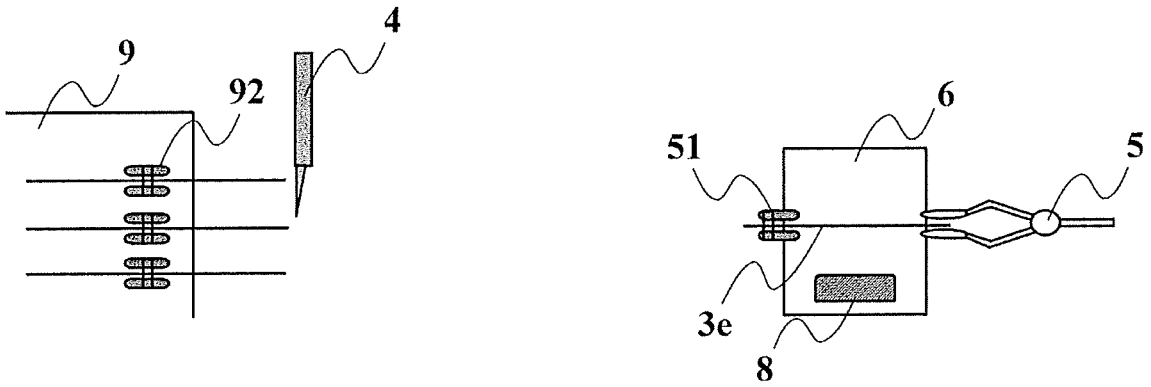
FIG. 9C is a schematic view showing an example of a state in which the transport arm transported the film.
Figure 9D:
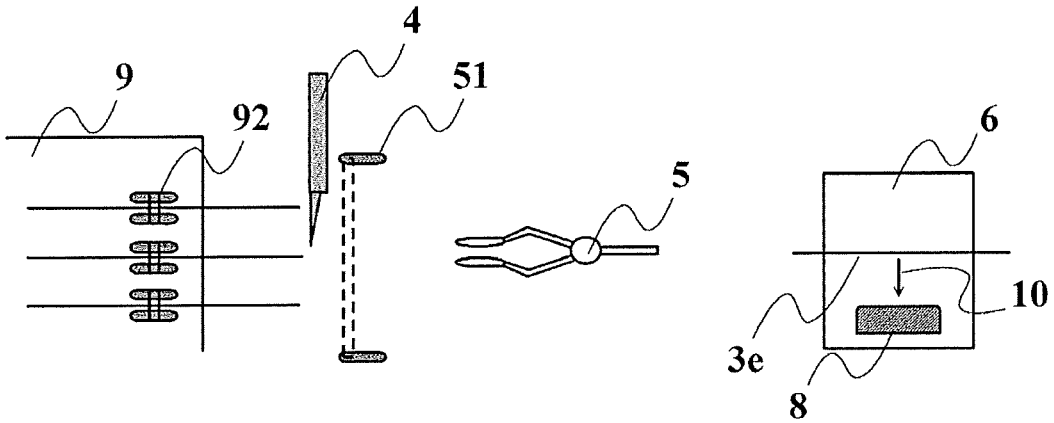
FIG. 9D is a schematic view showing an example of a state in which the transport arm returned to an operation start position.

Next, a modified example of the film transport apparatus according to this embodiment will be described with reference to FIG. 9. FIG. 9 is a schematic view showing an example of an operation of the film transport apparatus including a second transport arm. In the example of FIG. 9, the second transport arm 51 closer to a side where a film is pulled out than the film cutting unit 4 is. As shown in the example of FIG. 9A, the second transport arm 51 is firstly disposed in a state where the upper and the lower parts thereof are spread apart sufficiently. The first transport arm 5 passes between the upper and the lower parts of the second transport arm 51, grabs a selected film 3*d*, and pulls out the selected film 3*d* so that it has a predetermined length. Next, as shown in the example of FIG. 9B, the film 3 is held and grasped by lessening the space between the upper and the lower parts of the second transport arm 51. Next, the film cutting unit 4 cuts the film 3. As shown in the example of FIG. 9C, the film 3*e* cut by the film cutting unit 4 is transported to, for example, a film attachment unit 6, which is described later, while the first and the second transport arms 5 and 51 hold both ends of the film 3*e*. The first and the second transport arms 5 and 51, after transporting the film, return to a predetermined origin position where operations starts (FIG. 9D). After being transported, the cut film 3*e* is attached to, for example, a workpiece 8 or the like by the film attachment unit 6. The second transport arm 51 can be used by appropriately selecting from those similar to the first transport arm 5. According to the above film transport apparatus, when a distance to a place where a film is used is long relative to a necessary film length, use efficiency of the film can be improved. Further, a film can be cut and transported while applying tension thereto and thereby can be transported, for example, in a state in which it is easy to attach it to a workpiece.

Figure 10:
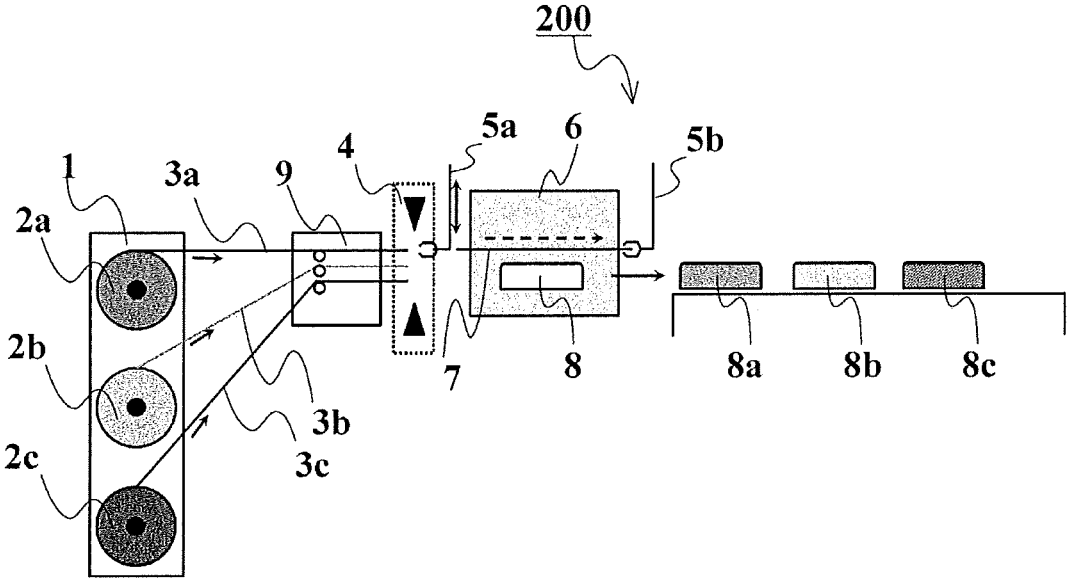
FIG. 10 is a schematic view showing an example of a film attachment apparatus according to the embodiment.

Next, the film attachment apparatus according to this embodiment will be described with reference to FIG. 10. FIG. 10 is a schematic view showing an example of the film attachment apparatus according to this embodiment. A film attachment apparatus 200 shown in the example of FIG. 10 includes: the film transport apparatus of this embodiment; and a film attachment unit 6 that is provided closer to a side where a film is pulled out than a film cutting unit 4 is, in which the film attachment unit 6 includes a container body capable of accommodating a workpiece 8 and a lid body that seals the container body, the first transport arm 5*a* is provided so as to be able to pass between the container body and the lid body, and the first arm transport arm 5*a* grasping the film passes between the container body which has accommodated the workpiece 8 and the lid to place the film 7 on the workpiece 8.

The film attachment unit 6 can be, for example, a vacuum attachment apparatus or the like. A configuration of the vacuum attachment apparatus can be selected from any configuration previously known. Examples of a method for attaching a film include a method in which the film attachment unit 6 accommodates the workpiece 8 in a container included therein, and a desired film is placed on the workpiece 8. Further, they include a method for attaching a film to a workpiece in which, after the container is sealed with a lid to make the whole container vacuum, a lid side is opened to the atmosphere. In the film attachment apparatus according to this embodiment, the lid is opened to accommodate the workpiece 8 in the container and the first transport arm 5*a* that grasps a film is subsequently made to pass over an opening of the container body so that a film 7 can be placed on the workpiece 8 and thereby an attachment process can be performed continuously.

With the film attachment apparatus according to the above embodiment, different films can be used by replacing them every time by using one line without replacing film rolls and products having different colors in units of one piece can be manufactured. Therefore, in particular, the film attachment apparatus according to this embodiment can be suitably used as a film attachment apparatus for one-piece flow production.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A film transport apparatus, comprising:

a film holder configured to hold a long-length film; and a film cutter configured to cut out the film, wherein the film holder holds a plurality of the films, and the film transport apparatus further comprising:

a temporary holder configured to include a plurality of temporary holding mechanisms that temporally hold the films between the film holder and the film cutter; and a first transport arm configured to select and pull out one selected film from the plurality of films which are held in the temporary holder, wherein the plurality of temporary holding mechanisms are configured so that a relative distance between each of the holding mechanisms can be respectively changed, and the plurality of temporary holding mechanisms are movable such that a relative vertical distance between a first temporary holding mechanism that holds the one selected film and a second temporary holding mechanism is increased during selection of the one selected film.

2. The film transport apparatus according to claim 1, comprising a contact part wherein the temporary holding mechanism applies a frictional force on both sides of the film.

3. The film transport apparatus according to claim 1, wherein the temporary holding mechanisms are configured to maintain a relative distance between the plurality of temporary holding mechanisms until a next film is selected, and to maintain the relative distance when the next film is the same as that previously selected.

4. The film transport apparatus according to claim 1, comprising a second transport arm closer to a side where a film is pulled out than the film cutter, wherein after the first transport arm has pulled out the film, the second transport arm grasps the pulled film before the film cutter cuts out the pulled film.

5. A film attachment apparatus, comprising:

the transport apparatus according to claim 1; and a film attachment unit that is provided closer to a side where a film is pulled the film cutter is, wherein the film attachment unit includes a container body capable of accommodating a workpiece and a lid body that seals the container body, the first transport arm is provided so as to be able to pass between the container body and the lid body, and the first arm transport arm that grasps the film passes between the container body which has accommodated the workpiece and the lid to place the film on the workpiece.

* * * * *